US010224167B2

(12) United States Patent
Xu et al.

(10) Patent No.: US 10,224,167 B2
(45) Date of Patent: Mar. 5, 2019

(54) THERMAL FUSE

(71) Applicants: Zhonghou Xu, Xiamen (CN); Yousheng Xu, Xiamen (CN)

(72) Inventors: Zhonghou Xu, Xiamen (CN); Yousheng Xu, Xiamen (CN)

(73) Assignee: XIAMEN SET ELECTRONICS CO., LTD, Xiamen (CN)

( * ) Notice: Subject to any disclaimer, the term of this patent is extended or adjusted under 35 U.S.C. 154(b) by 470 days.

(21) Appl. No.: 14/781,044

(22) PCT Filed: Mar. 28, 2014

(86) PCT No.: PCT/CN2014/074277
§ 371 (c)(1),
(2) Date: Sep. 29, 2015

(87) PCT Pub. No.: WO2014/154169
PCT Pub. Date: Oct. 2, 2014

(65) Prior Publication Data

US 2016/0042905 A1 Feb. 11, 2016

(30) Foreign Application Priority Data

Mar. 29, 2013 (CN) ..... 2013 1 0108845

(51) Int. Cl.
*H01H 85/36* (2006.01)
*H01H 37/76* (2006.01)
*H01H 85/00* (2006.01)

(52) U.S. Cl.
CPC ..... *H01H 85/36* (2013.01); *H01H 37/764* (2013.01); *H01H 37/765* (2013.01);
(Continued)

(58) Field of Classification Search
CPC ..... H01H 37/764–37/767; H01H 2037/762; H01H 85/0047; H01H 85/36
(Continued)

(56) References Cited

U.S. PATENT DOCUMENTS 3,727,164 A * 4/1973 Cartier ..... H01H 37/765 337/405
3,821,685 A * 6/1974 Kimball ..... H01H 37/764 337/407
(Continued)

FOREIGN PATENT DOCUMENTS

CN 1750205 A 3/2006
CN 202513078 U 10/2012
(Continued)

*Primary Examiner* — Jacob R Crum
(74) *Attorney, Agent, or Firm* — Gokalp Bayramoglu

(57) ABSTRACT

The present invention discloses a thermal fuse having dual metal elastic clamps, comprising: an insulating cylindrical tube; a first metal cap, a temperature sensing chamber formed by the first metal cap, the second metal tube and the inner side wall of the middle part of the through hole. The temperature sensing chamber axially arranges a plurality of components in the following sequence: a compressed spring; an insulating supporting pillar; a second metal elastic clamp; a connecting pillar a first metal elastic clamp; an organic temperature sensing body capable of melting when heating. The first metal elastic clamp, the second metal elastic clamp and the connecting pillar forms a movable conductive bridge. The movable conductive bridge slides flexibly in the temperature sensing chamber and has low contacting resistance with the first metal cap and the second metal tube. The above structure can withstand large current and has high reliability.

17 Claims, 16 Drawing Sheets

(52) U.S. Cl.
CPC ..... *H01H 37/767* (2013.01); *H01H 85/0047* (2013.01); *H01H 2037/762* (2013.01)

(58) Field of Classification Search
USPC ..... 337/407
See application file for complete search history.

(56) References Cited

U.S. PATENT DOCUMENTS 3,930,215 A * 12/1975 Senor ..... H01H 37/765 337/407
3,944,960 A 3/1976 Audette et al.
4,127,839 A * 11/1978 Ito ..... H01H 37/764 337/408
4,184,139 A * 1/1980 Hara ..... H01H 1/10 337/407
4,189,697 A * 2/1980 Hara ..... H01H 37/765 337/407
4,281,308 A * 7/1981 McVey ..... H01H 37/765 337/407
4,281,309 A * 7/1981 Olson ..... H01H 37/765 29/623
4,305,202 A * 12/1981 Plasko ..... H01H 37/765 29/622
4,384,267 A * 5/1983 Aoki ..... H01H 37/765 337/407
4,401,965 A * 8/1983 Backlund ..... H01H 37/765 337/407
4,821,010 A * 4/1989 Plasko ..... H01H 61/02 337/183
5,612,663 A * 3/1997 Hollweck ..... H01H 37/002 337/150
2010/0219929 A1 * 9/2010 Lee ..... H01H 37/765 337/182

FOREIGN PATENT DOCUMENTS

CN 203118864 U 8/2013
JP H10177833 A 6/1998
SU 1181003 A1 9/1985
SU 1408468 A1 7/1988

* cited by examiner

THERMAL FUSE

FIELD OF THE INVENTION

The present invention relates to a thermal fuse, and more specifically to an organic temperature-sensing thermal fuse which is capable of resisting large surge current.

BACKGROUND OF THE INVENTION

An over-current protecting has been widely used in manufacturing home appliance and industrial equipment because excessive heating induced by electricity can result into fire. Except for the over-temperature protecting, an over-temperature protection is also needed.

Currently, existing non-resettable thermal fuse used can be sorted into two categories. One category of the thermal fuse uses alloy with low melting point as temperature sensing component. The other category of the thermal fuse uses pressed organic material as a temperature sensing body. A metal elastic clamp contacts with a lead wire electrode through the joining force coming from a compressed compression spring and the temperature sensing body, thus forming a single contact point conductive structure. When the temperature of the environment reaches a pre-set temperature, the temperature sensing body melts. A thin compression spring forces the metal elastic clamp separate from the lead wire electrode, thus cutting off the electric connection. The single contact point conductive structure between the elastic clamp and lead wire electrode has the drawback of high contacting resistance. This conductive structure cannot withstand high current. When surge current flows through the device, a resistance welding would occur and thus disabling the protecting function of the thermal fuse.

BRIEF DESCRIPTION OF THE INVENTION

The present invention overcomes the drawback of existing technology and provides an organic temperature sensing thermal fuse, comprising an insulating cylindrical tube, a first metal cap and a second metal tube to form a temperature sensing chamber. The temperature sensing chamber axially arranges a plurality of components in the following sequence: an organic temperature sensing body; a conductive bridge; an insulating supporting pillar a spring compressed by the insulating supporting pillar; when the organic temperature sensing body melts after heating, the spring pushes the conductive bridge towards the organic temperature sensing body. The conductive bridge thus achieves or cuts off the electric connection between the first metal cap and the second metal tube.

The conductive bridge has multiple contacting points with the metal tube, thus forming a structure which equivalently has multiple parallel branches. This structure lowers the contacting resistance, decreasing the heating power when a surge current flows through this device. The value of working current and the ability to withstand current shock are thus increased.

The present invention discloses a thermal fuse having dual metal elastic clamps, which comprise: an insulating cylindrical tube with an axially through hole; a first metal cap, wherein one end of the first metal cap is axially fixed on one end of the through hole, the other end of the first metal cap is connected with a first conducting wire extending outward; a second metal tube, wherein one end of the second metal tube is axially fixed on the other end of the through hole, the other end of the second metal tube is connected with a second conducting wire extending outward.

The first metal cap, the second metal tube and the inner side wall of the middle part of the through hole form a temperature sensing chamber. The temperature sensing chamber axially arranges a plurality of components in the following sequence from the first metal cap to the second metal tube: an organic temperature sensing body capable of melting when heated, a conductive bridge, an insulating supporting pillar and a compressed spring. The conductive bridge further axially arranges a plurality of components in the following sequence from the first metal cap to the second metal tube: a metal pad, a first metal elastic clamp, a connecting pillar and a second metal elastic clamp.

The first metal elastic clamp and the second metal elastic clamp comprise a circular base board and a plurality of arc-shaped extending parts bending toward the same side of the circular base board. The plurality of arc-shaped extending parts are glidingly connected with the inner wall of the temperature sensing chamber. The second metal tube, the second metal elastic clamp, the connecting pillar, the first elastic clamp and the first metal cap are electrically connected with each other.

The above invention can be modified as the following:

In one preferred embodiment, one end of the second conductive wire has a flat heading. The flat heading is located on the inner part of the second metal tube and rivets the lip-like edges of the second metal tube. The flat heading is electrically connected with the second metal tube.

In one preferred embodiment, the clamps of the first elastic clamp and the second elastic clamp bent towards the second metal tube.

In one preferred embodiment, the first metal elastic clamp and the second metal elastic clamp relative to the first metal cap and the second metal tube are in normally closed condition. The first metal elastic clamp is electrically connected with the first metal cap when the organic temperature sensing body is in rigid and melting position. The second metal elastic clamp is electrically connected with the second metal tube when the organic temperature sensing body is in rigid condition and electrically insulated with the second metal tube when the organic temperature sensing body is in melting position.

In another preferred embodiment, the first metal elastic clamp and the second metal elastic clamp relative to the first metal cap and the second metal tube are in normally open condition. A distance between the first metal elastic clamp and the second metal elastic clamp is greater than a distance between the first metal cap and the second metal tube. The first metal elastic clamp is electrically insulated with the first metal cap when the organic temperature sensing body is in rigid condition, while the first metal elastic clamp is electrically connected with the first metal cap when the organic temperature sensing body is in melting condition. The second elastic clamp is electrically connected with the second metal tube when the organic temperature sensing body is in rigid or melting conditions.

In one preferred embodiment, a contact surface between the second metal elastic clamp and the connecting pillar is a flat surface. A contact surface between the first metal elastic clamp and the connecting pillar is also as flat surface. The two flat contact surfaces are both perpendicular to the axis of the insulating cylindrical tube.

In one preferred embodiment, a heater is located on the outer wall of the insulating cylindrical tube, the heater can be heated up when powered on.

In one specific embodiment, the heater is metal resistance wire which has pins extending outwardly. Based on this specific embodiment, two pins are respectively located on two ends of the insulating cylindrical tube and electrically connected with the first metal cap and the second metal tube correspondingly.

In one preferred embodiment, the inner wall of the temperature sensing chamber is a smooth surface.

Beneficial effects of this invention are as following:

Firstly, the first metal elastic clamp, the second metal elastic clamp and the connecting pillar form a conductive bridge. This conductive bridge is a movable conductive component. Clamps from the two metal elastic clamps cooperate with the inner wall of the temperature sensing chamber from the side wall. The clamps slide flexibly in the temperature sensing chamber and have multiple contacting points with the first metal cap and the second metal tube. This results in a low contacting resistance and can withstand large current, thus increasing the reliability.

Secondly, the movable structure of the metal elastic clamp can form a normally closed and open embodiment.

Thirdly, the simple structure of the thermal fuse can cooperate with other heating components, thus achieving a function of initiative cut-off.

DETAILED DESCRIPTION OF THE INVENTION

A detailed description of the invention is described with the drawings. The invention of an organic temperature-sensing thermal fuse with multiple contacting points is not limited to these embodiments illustrated below, but conforms to a broadest scope consistent with the principle and novel features disclosed herein.

The First Embodiment

Figure 1A:
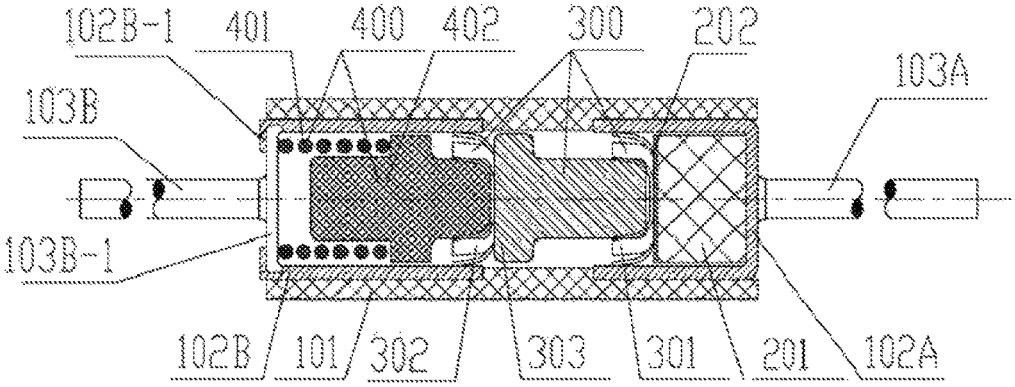
FIG. 1A is a cross section view of overall structure of an organic temperature sensing thermal use with multiple contacting points in the first embodiment, wherein the organic temperature sensing thermal fuse is in normally closed condition.

Referring to FIG. 1A, the present invention discloses an organic temperature-sensing thermal fuse having dual metal elastic clamps. The normally closed structure is formed as follow:

Insulating cylindrical tube 101 provides support for the overall structure and can be made of ceramic or engineering plastics. A first metal cap 102A and a second metal tube 102B are respectively embedded into two sides of insulating cylindrical tube 10. A first conductive wire 103A and the bottom of the first metal cap 102A are electrically connected with each other through riveting. The heading of the second conductive wire 103B is a flat heading 103B-1 and is inserted into the flaring step of the lip-like edges of the second metal tube 102B. The lip-like edge of the second metal tube 102B is screwed tightly and thus forms a conductive connection with the second conductive wire 103B. Conductive wires 103A and 103B respectively extend outwardly from two ends along the axis. A temperature sensing chamber is located between the first metal cap and the second metal tube. The temperature sensing chamber axially arranges a plurality of components in the following sequence from the first conductive wire 103A to the second conductive wire 103B through the second metal tube 102B; an organic temperature sensing body 201; a metal pad 202; a first metal elastic clamp 301; a connecting pillar 303; a second metal elastic clamp 302; an insulating supporting pillar 402 and a compressed spring 401.

Figure 2:
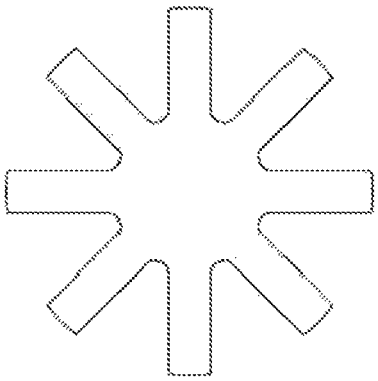
FIG. 2 is an upward view of organic temperature sensing thermal fuse with multiple contacting points of the first embodiment.
Figure 3:
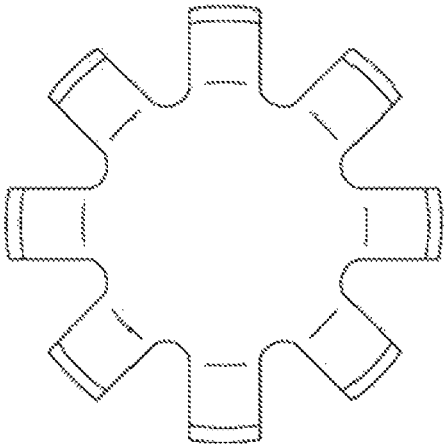
FIG. 3 is the front view of the organic temperature sensing thermal fuse with multiple contacting points of the first embodiment when being assembled into the metal tube.
Figure 4:
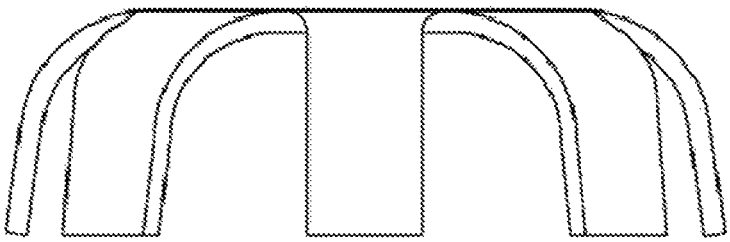
FIG. 4 is the side view of the organic temperature sensing thermal fuse with multiple contacting points of the first embodiment when being assembled into the metal tube.
Figure 5:
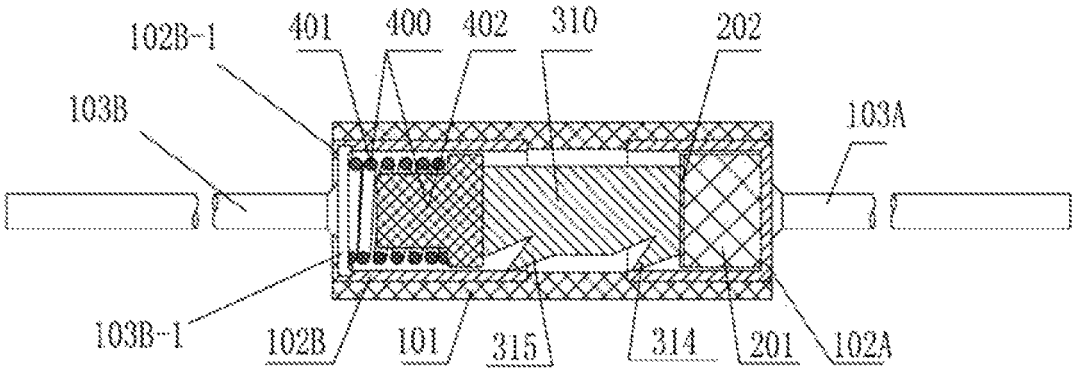
FIG. 5 is a cross section view of overall structure of an organic temperature sensing thermal fuse with multiple contacting points of the second embodiment.

Referring to FIGS. 2-4, the multiple clamps of the first metal elastic clamp 301 and the second metal elastic clamp 302 are symmetrically located with each other. The radial clamps are respectively assembled into the metal tubes 102A and 102B in bending shape. The two-way elasticity of the radial clamps due to bending is perpendicular to the inner wall of the metal tube and ensures a secure electric contact between the radial clamps and the metal tube. The middle part of the first elastic clamp 301 and the second elastic clamp 303 are parallel with each other and perpendicular to the middle line of metal tubes 102A and 102B. The first metal elastic clamp 301 is electrically connected with the second metal elastic clamp 303 through a connecting pillar 303 to form a conductive bridge 300. A metal pad 202 and an organic temperature sensing body 201 are located between the conductive bridge 300 and the first conductive wire 103A and are in close contact with the conductive bridge 300 and the first conductive wire 103A. A pushing unit 400 is laminated between the conductive bridge 300 and the second conductive wire 103B. An insulated supporting pillar 402 and a compressed spring 401 laminate together to form the pushing unit 400. The insulated supporting pillar 402 is located between the compressed spring 401 and the second metal elastic clamp 302. An elastic force is generated due to the compress of the compressed spring 401 when the thermal fuse is in normally closed condition.

When all the components are assembled together, the lip-like edge 102B-1 of the second metal tube 102B is screwed tightly and forms the overall structure of the thermal fuse. When assembling, an epoxy resin type blinder can be coated on the out peripheral of the first metal cap 102A and the second metal tube 102B in order to secure the insulating cylindrical tube 101, the first metal cap 102A and the second metal tube 102B. Then, the first metal cap 102A and the second metal tube 102B are pushed into the insulating cylindrical tube 101. The lip-like edges of the second metal tube 102B is also coated with an epoxy resin type blinder in order to form a closed chamber between the first metal cap 102A and the second metal tube 102B. Thus, a high-temperature stability of the organic temperature sensing body 201 can be improved.

The organic temperature sensing body 201 melts from solid to liquid and loses holding force when outside temperature exceeds the melting point of the organic temperature sensing body 201. The compressed spring 401 pushes the insulating support column 402 and the conductive bridge 300 move towards the first conductive wire 103A. The electric circuit will be cut of when the second metal elastic clamp 302 separates from the second metal tube 102B and reaches the middle part of the insulating cylindrical tube 101. Thus, a function of over-temperature protection can be achieved.

When the rated current is set at AC with a value of 15 A, the organic temperature-sensing thermal fuse having dual metal elastic clamps can withstand a peak value of 10 KA when a surge current with a value of 8*20 μS flows. A current welding can be avoided. Thus the thermal fuse will never lose the over-temperature protection due to the invalidation of becoming a permanent conductive thermal fuse. Existing thermal fuse uses one conductive to directly contact the organic temperature-sensing thermal fuse having single metal elastic clamp. When a 8*20 μS current flows through the existing thermal fuse and the current value exceeds 3 KA, a current welding occurs. The existing thermal fuse thus becomes a permanent conductive thermal fuse and loses the function of over-temperature protection.

The conductive bridge 300, the first metal cap 102A and the second metal tube 102B form a normally closed structure. The normally closed structure exists when the organic temperature sensing body is in rigid condition and the first metal elastic clamp 301, the second metal elastic clamp 302 are respectively connected with the first metal cap 102A and the second metal tube 102.

Figure 1B:
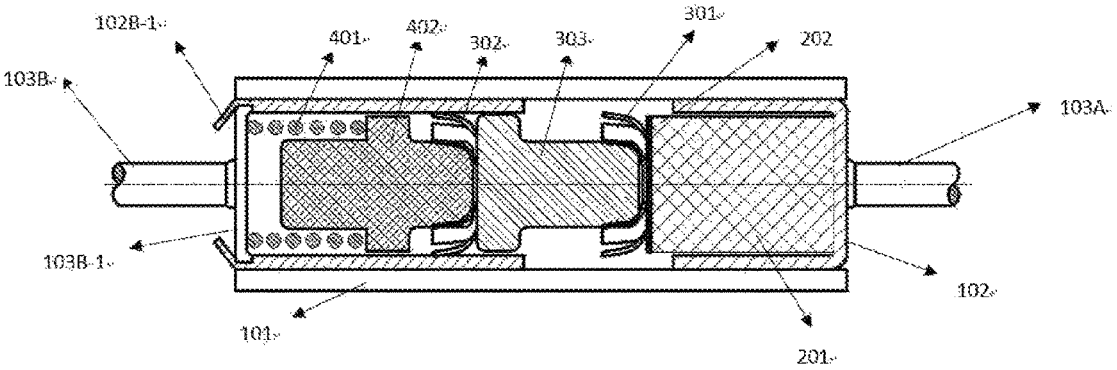
FIG. 1B is a cross section view of overall structure of an organic temperature sensing thermal fuse with multiple contacting points in the first embodiment, wherein the organic temperature sensing thermal fuse is in normally open condition.

Similarly, the thermal fuse can be a normally open structure referring to FIG. 1B. This can be achieved when a distance between the clamps of the first elastic clamp 301 and second elastic clamp 302 is larger than the distance between the first metal cap 102A and the second metal tube 102B. The first metal elastic clamp 301 does not connect with the first metal cap when the organic temperature sensing body is in rigid condition. Likewise, by adjusting the axial position of the conductive bridge 300 and other components inside the insulating cylindrical tube 101, a normally open structure can be formed. For example, in FIG. 1B, the second metal tube 102B is extended and the first metal cap 102A is shorten to stagger a position of an elastic clamp. The second metal elastic clamp 302 can be assembled inside the second metal tube 102B and the first metal elastic clamp 301 is assembled in the middle part of the insulating cylindrical tube 101. The organic temperature sensing body 201 melts from solid to liquid and loses holding force when the outside temperature exceeds the melting point of the organic temperature sensing body 201. A pushing unit 400 pushes the conductive bridge 300 comprising the first metal elastic clamp 301, the second metal elastic clamp 302 and the connection column 303 toward the first metal cap 102A, resulting in that the first metal elastic clamp 301 is located inside the first metal cap 102A and the second metal elastic clamp 302 is located inside the second metal tube 102B. The first metal cap 102A, the first metal elastic clamp 301, the connection column 303, the second metal elastic clamp 302 and the second metal tube 102B are in series with each other and form a conductive body, placing the circuit from normally open to normally closed.

The Second Embodiment

Figure 6:
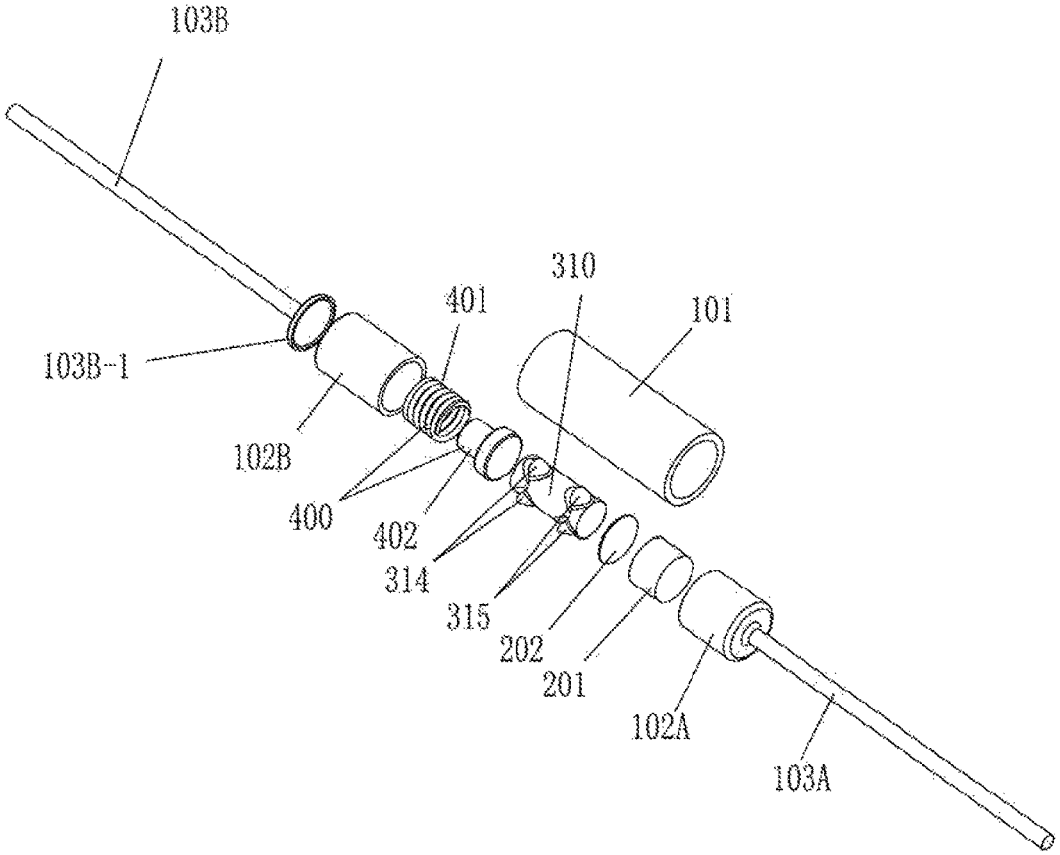
FIG. 6 is an exploded view of an organic temperature sensing thermal fuse with multiple contacting points of the second embodiment.
Figure 7A:
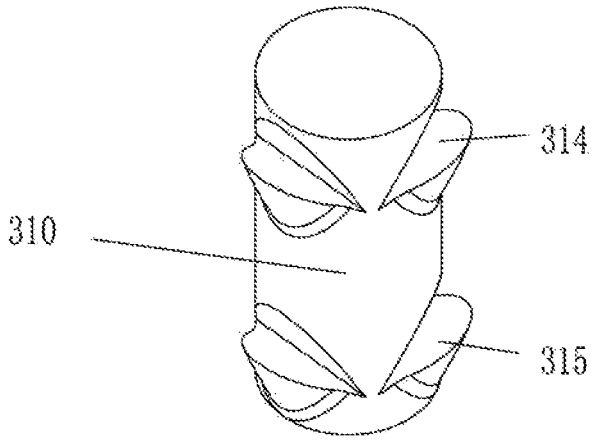
FIGS. 7A and 7B are the stereogram of conductive bridge of organic temperature sensing thermal fuse with multiple contacting points of the second embodiment.
Figure 7B:
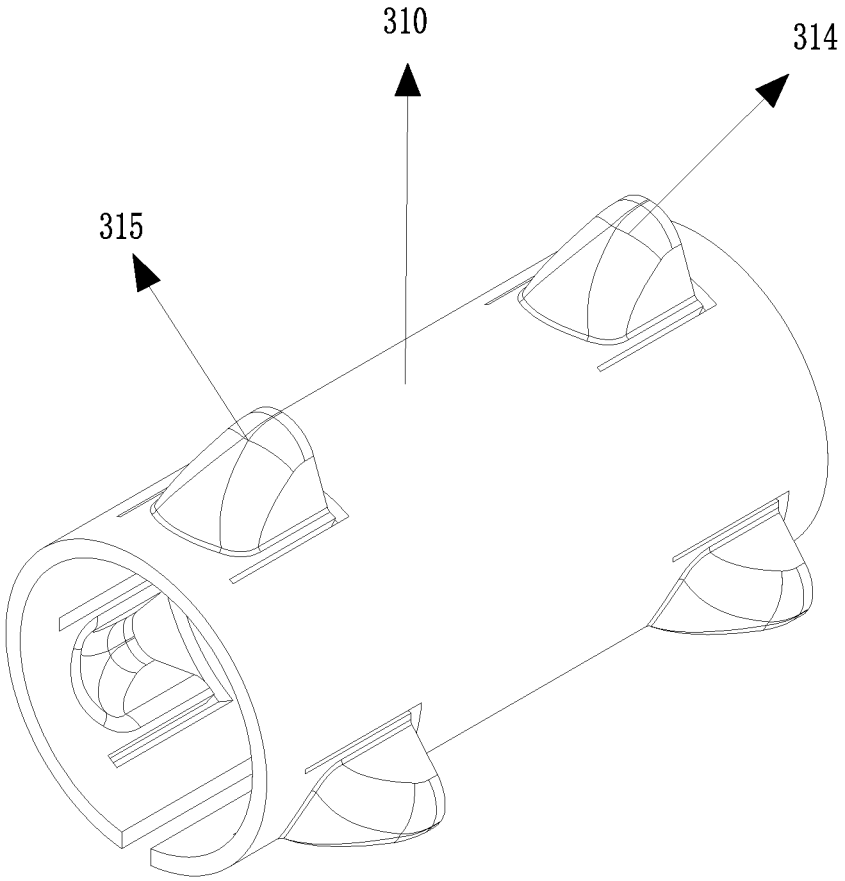
Figure 8:
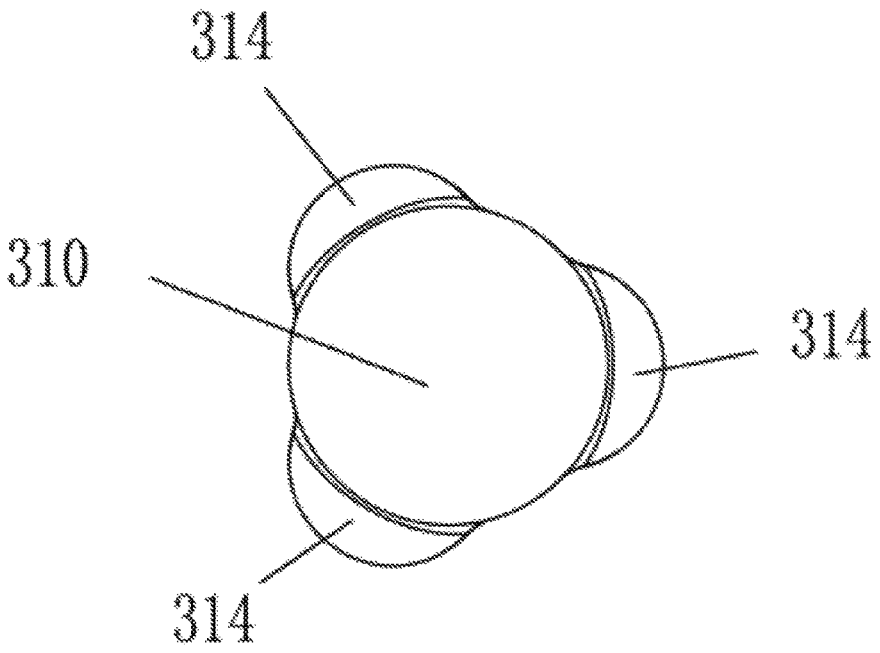
FIG. 8 is the top view of conductive bridge of the organic temperature sensing thermal fuse with multiple contacting points in the second embodiment.

Referring to FIGS. 6-8, this embodiment resembles the first embodiment. The thermal fuse comprises an insulating cylindrical tube 101 made of ceramic or engineering plastics. A first metal cap 102A and a second metal tube 102B are respectively embedded into two ends of the insulating cylindrical tube. A first conductive wire 103A and the bottom of the first metal cap 102A is electrically connected with each other through riveting. The heading of the second conductive wire 103B is a flat heading 103B-1 and is inserted into the flaring step of the lip-like edges of the second metal tube 102B. The lip-like edges of the second metal tube 102B is screwed tightly and thus forms a conductive connection with the second conductive wire 103B. Conductive wires 103A and 103B respectively extend outwardly from two ends along the axis. A temperature sensing chamber is defined between the first metal cap and the second metal tube. An organic temperature sensing body 201, a conductive bridge 301, an insulating pillar 402, a spring 401 are fixed inside the temperature sensing chamber. Wherein the spring 401 is compressed by the insulating pillar 402. When the organic temperature sensing body 201 melts due to heating, the spring 401 pushes the conductive bridge 300 toward one side of the organic temperature sensing body 201. Thus the electric connection between the first metal cap 102A and the second metal tube 102B can be achieved or cut off.

Conductive bridge 300 comprises a conductive pillar 310, two rows of petal shaped wings 314 and 315. The petal shaped wings are formed by cleaving a copper cylinder radially and extend outwardly to form an integrative structure. The two rows of petal shaped wings 314 and 315 are respectively and electrically connected with the first metal cap 102A and the second metal tube 102B.

Likewise, the second embodiment can be processed with a normally open structure as the first embodiment.

The Third Embodiment

Figure 9:
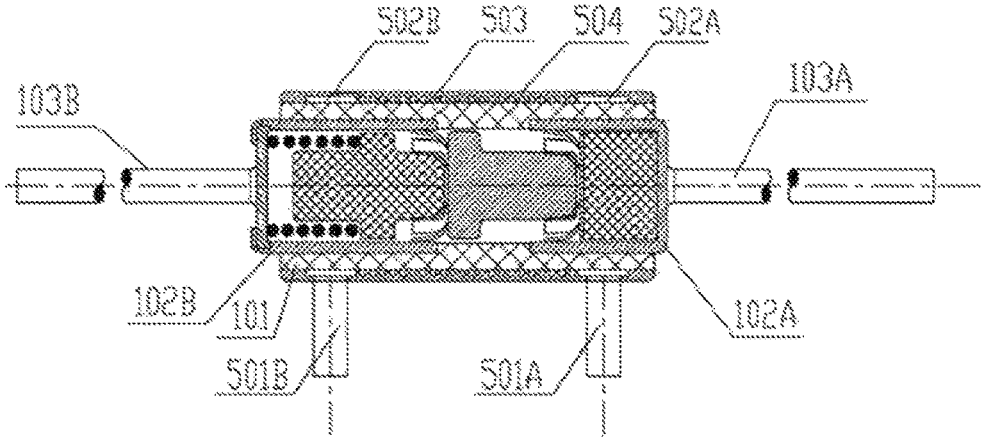
FIG. 9 is the cross sectional view of conductive bridge of the organic temperature sensing thermal fuse with multiple contacting points in the third embodiment.

Referring to FIG. 9, the present disclosure discloses an organic temperature-sensing thermal fuse having dual metal elastic clamps which have the function of actively cutting off the circuit. Metal rings 502A and 502B are respectively located on two ends of the insulating cylindrical tube 101 and have pins 501A and 501B extending outwardly. A metal resistance is winded on the surface of the insulating cylindrical tube 101 and the metal resistance is located between the metal rings 502A and 502B. A metal film or carbon film resistance can be coated on the surface of the insulating cylindrical tube 101 to form a heater, which can actively cut off the circuit. When the outside temperature reaches the pre-set temperature, the organic temperature sensing body melts.

If the input power source for the heater is the main circuit, the metal ring can be directly set on the first metal cap 102A. Metal resistance wire, metal film or carbon film resistance passes through the surface of the insulating cylindrical tube 101 and extends to metal ring 502B, thus pin 501A can be reduced.

The Fourth Embodiment

Figure 10:
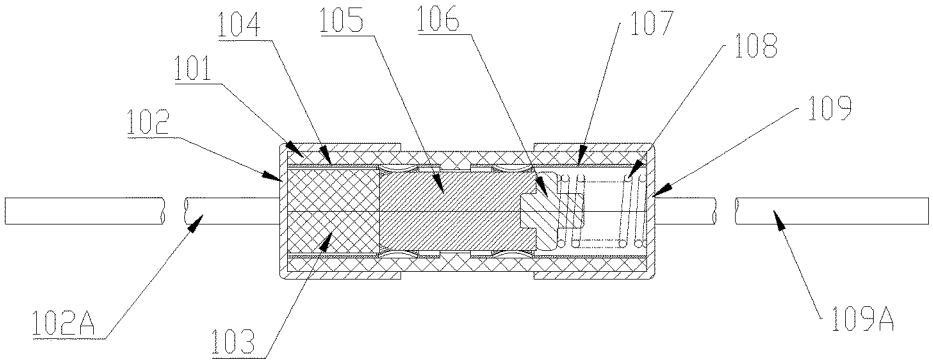
FIG. 10 is the cross sectional overview structure of the fourth embodiment.
Figure 11:
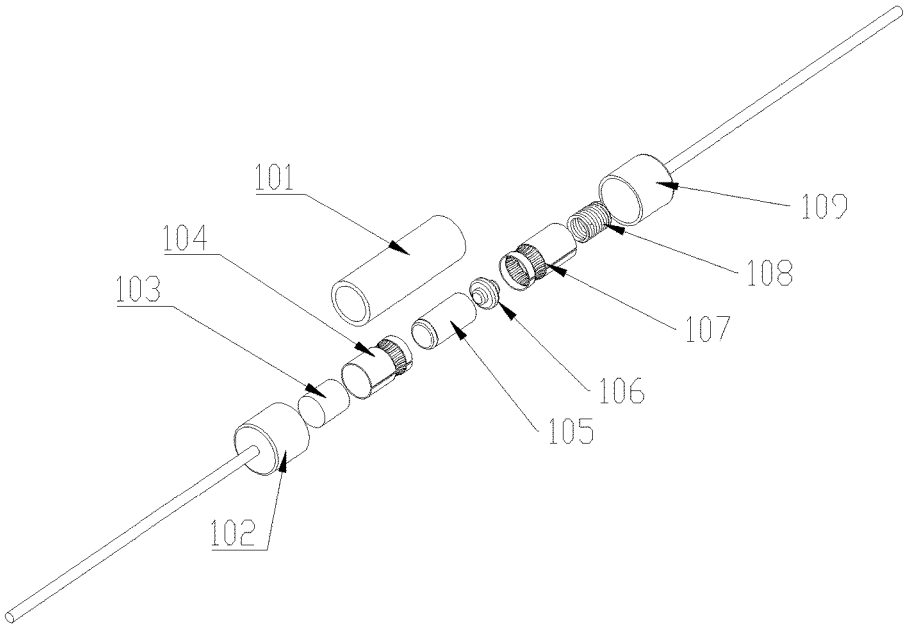
FIG. 11 is the exploded view of the fourth embodiment.

Referring to FIGS. 10-11, the present invention discloses an organic temperature sensing thermal fuse comprising: an insulating cylindrical tube 101 with an axial through hole; a first metal cap 102, wherein one end of first metal cap 102 is axially fixed on one end of insulating cylindrical tube 101, the other end of first metal cap 102 is connected with a first conducting wire 102A extending outward; a second metal tube 109, wherein one end of the second metal tube 109 is axially fixed on the other end of insulating cylindrical tube 101. The other end of second metal tube 109 is connected with a second conducting wire 109A. Insulating cylindrical tube 101, first metal cap 102 and second metal tube 109 form a closed chamber. First convex reed 104 with thin and flexible contact points and second convex reed 107 with thin and flexible contact points are installed inside the two ends of the closed chamber. One end of first convex reed 104 is connected to first metal cap 102. One end of second convex reed 107 is connected to second metal cap 109. A certain distance is set aside between first convex reed 104 and second convex reed 107. A plurality of components are axially arranged in the following sequence from the inner side of first convex reed 104 to second convex reed 107; an insulated and meltable temperature sensing body 103 cylinder conductive pin 105, insulated pushing block 106 and compressed spring 108, those components are arranged linearly. One end of first convex reed 104 and one end of second convex reed 107 are respectfully and flexibly connected to the two ends of cylinder conductive pin 105. First metal cap 102, first convex reed 104, cylinder conductive pin 105, second convex reed 107 and second metal cap 109 are thus electrically connected with each other.

Figure 12:
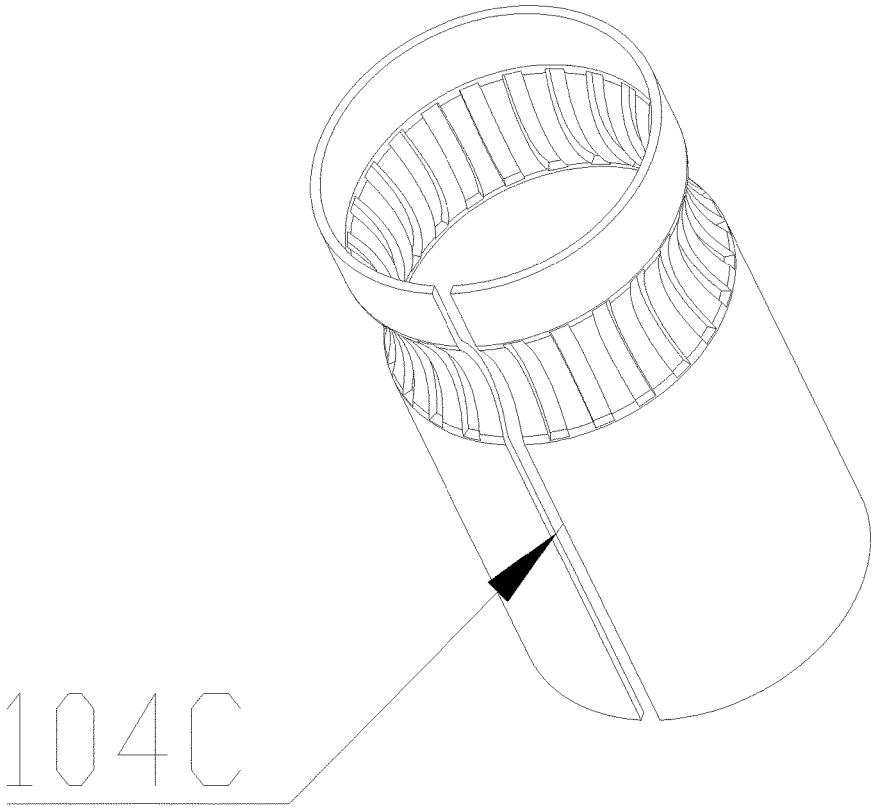
FIG. 12 is a schematic view of the circular and flexible convex reed with one end having convex arc-shaped section of the fourth embodiment.
Figure 13:
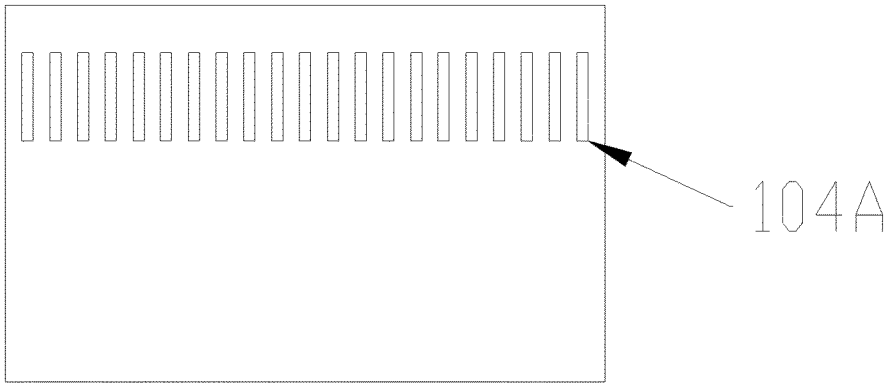
FIG. 13 is a top view of the unfolded circular and flexible convex reed of FIG. 12.
Figure 14:
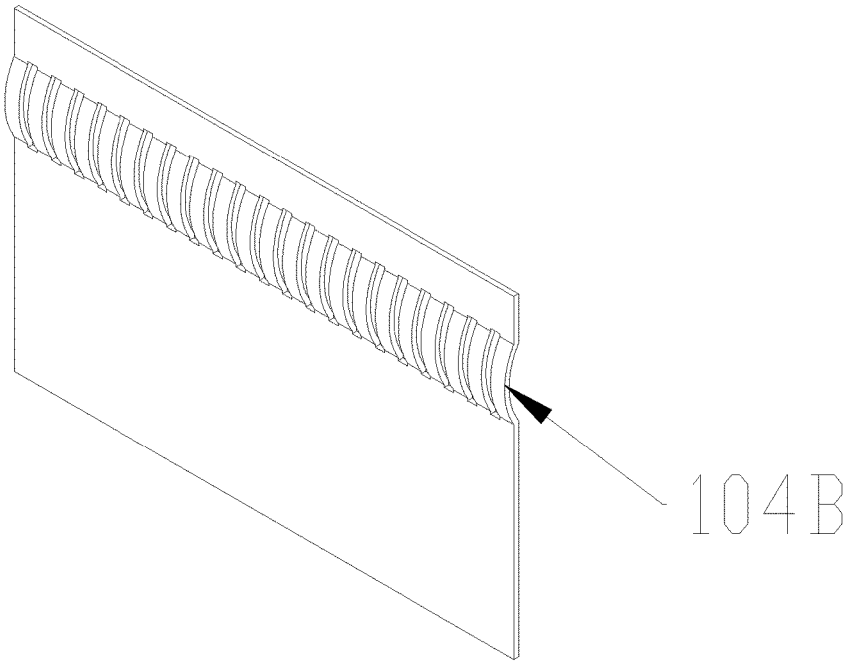
FIG. 14 is the side view of the unfolded circular and flexible convex reed of FIG. 12.

Referring to FIGS. 12-14, convex reeds are linearly arranged grid slots 104A which can be achieved by cutting a flexible metal piece using laser. Grid slots 104A can be made into flexible arc-shaped structure 104B through cold stamping. When curving the flexible metal piece into cylinder shape towards the direction of grid slots 104A and taking flexible arc-shaped structure 104B as an inner side, the flexible arc-shaped structure 104B indents towards the inner side of insulating cylindrical tube 101. Grid slots 104A are then radially arranged. As the convex reeds are obtained through curving a plane metal piece, there exists gap 104C between the connecting part. When the convex reeds are assembled into insulating cylindrical tube 101, an inner shrink process can be achieved to make the assembly more conveniently. When the convex reeds are assembled into insulating cylindrical tube 101, the outer wall of convex reeds pushes against the inner wall of insulating cylindrical tube 101. When an elastic interference occurs, the elastic force forces flexible arc-shaped structure 104B to extend towards free end. Gap 104C automatically shrinks and is adjusted to maintain a stable contact pressure between the convex reeds and cylindrical conductive pin 105.

Elastic convex reeds are obtained from curving the metal piece. Grid slots 104A is arranged radically. Cylindrical conductive pin 105 is installed inside flexible arc-shaped structure 104B. A linear and multiple contact points along the axis between the arc-shaped surface of elastic convex reeds and the cylinder surface of cylindrical conductive pin 105 are achieved due to an elastic deformation of convex reeds.

Cylindrical conductive pin 105 is used as an active connective point for first convex reed 104 and second convex reed 104. The length of the temperature sensing body 103 exceeds the distance when cylinder conductive pin 105 slides off second convex reed 107. When temperature sensing body 103 heats up due to abnormal rising of outside temperature, temperature sensing body 103 is in melting position. The compressed spring 108 releases an elastic force and pushes cylinder conductive pin 105 away from second convex reed 107. This results in an one-time electric cut-off between first metal cap 102 and second metal cap 109 without recovery.

Embodiment 5

Figure 15:
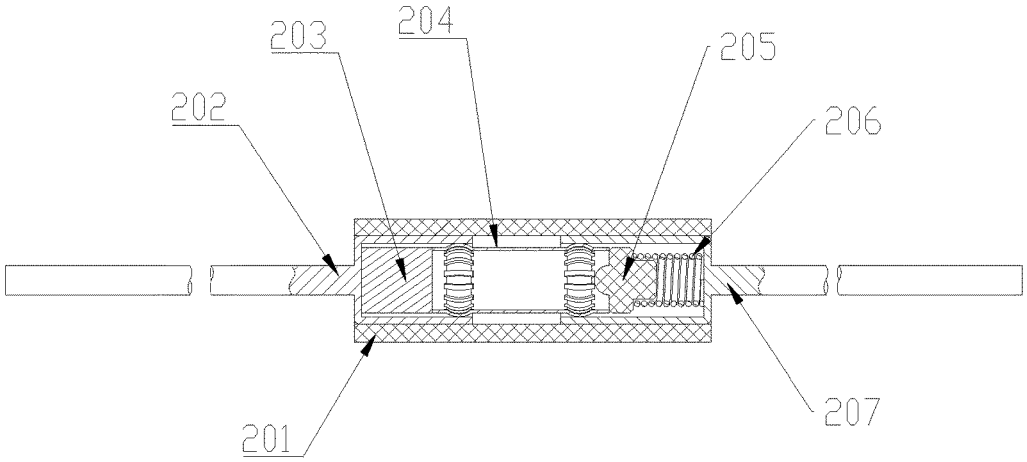
FIG. 15 is the cross sectional view of the overall structure of the fifth embodiment.
Figure 16:
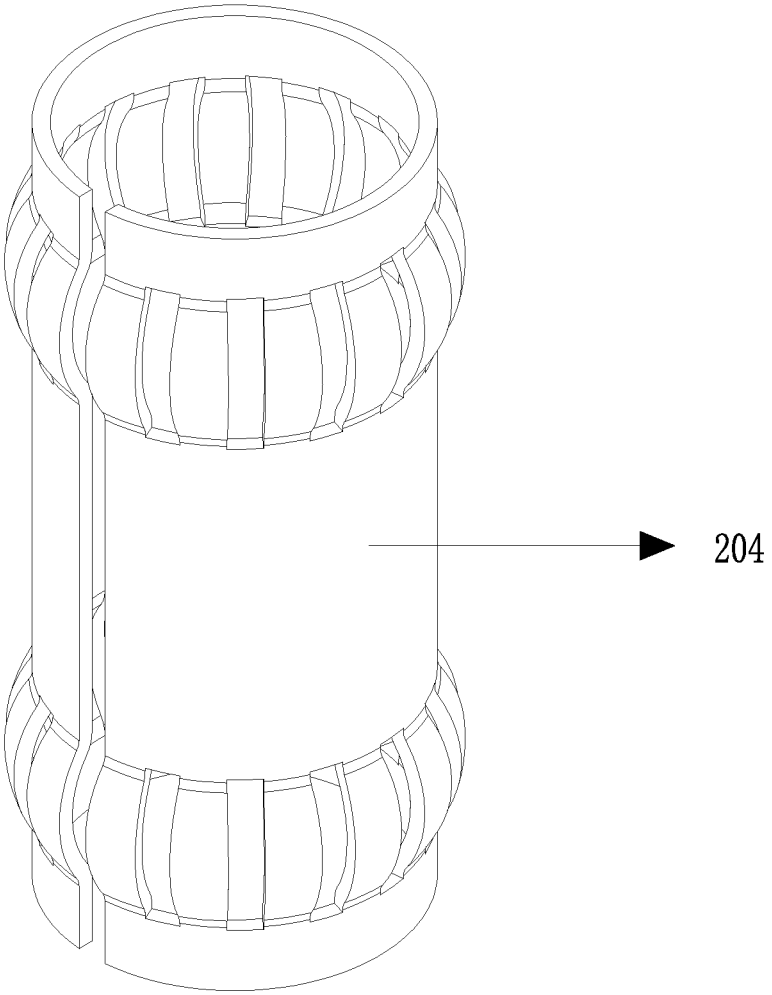
FIG. 16 is a topography of the circular and flexible convex reed with two ends having convex arc-shaped sections.

Referring to FIG. 15, insulating cylindrical tube 201 has an axial through hole. A first metal cap 202 with lead pin and a second metal cap 207 with lead pin are respectfully sleeved into through hole. Insulating cylindrical tube 201, a first metal cap 202 with lead pin and to second metal cap 207 with lead pin form a closed chamber. A temperature sensing body 203 is located inside the closed chamber. One end of temperature sensing body 203 is in close contact with the inner wall of first metal cap 202 while the other end of temperature sensing body 203 is in close contact with cylindrical elastic convex reed 204 with convex arc-shaped parts in both of the ends, see FIG. 16. The cylindrical elastic convex reed 204 is elastically and electrically connected with the first metal cap with lead pin 202 and the second metal cap with lead pin 207 to form an electric connection between first metal cap 202, cylindrical elastic convex reed 204 and second metal cap 207. One end of cylindrical elastic convex reed 204 is in close contact with insulated pushing block 205 due to the forces generated by compressed spring 206. Compressed spring 206 does not electrically connected with cylindrical elastic convex reed 204. When temperature sensing body 203 heats up due to abnormal rising of outside temperature, temperature sensing body 203 is in melting position. Compressed spring 206 releases an elastic force and pushes cylindrical elastic convex reed 204 away from second metal cap 207. This result in an one-time electric cut-off between first metal cap 202 and second metal cap 207 without recovery.

Beneficial effects of this invention are as following:

Using an integrated structure or constructing a conductive bridge formed by a first metal elastic clamp, a second metal elastic clamp and a connecting pillar.

Temperature sensing body melts when the outside temperature is abnormal; this conductive bridge is a movable conductive component. Clamps from the two elastic clamps cooperate with the inner wall of the temperature sensing chamber from the side wall. The clamps slide flexibly in the temperature sensing chamber and have multiple contact points with the first metal cap and the second metal tube. This results in as lower contacting resistance and can withstand a large current, thus increasing the reliability.

While the foregoing written description of the invention enables one of ordinary skill to make and use what is considered presently to be the best mode thereof, those of ordinary skill will understand and appreciate the existence of variations, combinations, and equivalents of the specific embodiment, method and examples herein. The invention should therefore not be limited to the above described embodiments, but by all embodiments and methods within the scope and spirit of the invention.

The invention claimed is:

1. A thermal fuse having dual elastic clamps comprising:

an insulating cylindrical tube comprising an axial through hole;

a first metal cap fixed axially on an end of the axial through hole and a first conductive wire fixed on the first metal cap and extending outwardly;

a second metal tube fixed axially on the other end of the axial through hole and a second conductive wire fixed on the second metal tube and extending outwardly;

wherein the first metal cap, the second metal tube and an inner side wall of the middle part of the axial through hole form a temperature sensing chamber; the temperature sensing chamber axially arranges a plurality of components in a following sequence from the first metal cap to the second metal tube: an organic temperature sensing body that melts when heated; a metal pad; a first metal elastic clamp; a connecting pillar; a second metal elastic clamp; an insulating supporting pillar and a compressed spring; the first metal elastic clamp and the second metal elastic clamp each have a plurality of curving and radialized clamps; each of the plurality of curving and radialized clamps are glidingly connected with an inner wall of the temperature sensing chamber; the second metal tube, the second metal elastic clamp, the connecting pillar, the first metal elastic clamp and the first metal cap are electrically connected with each other.

2. The thermal fuse having dual elastic clamps of claim 1, wherein the first metal elastic clamp, the second metal elastic clamp and the connecting pillar form an integrated structure.

3. The thermal fuse with dual elastic clamps of claim 1, wherein the first metal elastic clamp and the second metal elastic clamp relative to the first metal cap and the second metal tube form a normally closed structure; the first elastic clamp is electrically connected with the first metal cap when the organic temperature sensing body is in solid and melted conditions; the second metal elastic clamp is electrically connected with the second metal tube when the organic temperature sensing body is in the solid condition and loses electrical connection with the second metal tube when the organic temperature sensing body is in the melted condition.

4. The thermal fuse with dual elastic clamps of claim 1, wherein the first metal elastic clamp and the second metal elastic clamp relative to the first metal cap and the second metal tube form a normally open structure; a clamp distance between the first metal elastic clamp and the second metal elastic clamp is longer than the distance between the first metal cap and the second metal tube; the first metal elastic clamp is electrically insulated with the first metal cap when the organic temperature sensing body is in a solid condition; the first metal elastic clamp is electronically connected with the first metal cap when the organic temperature sensing body is in a melted condition; the second metal elastic clamp is electrically connected with the second metal tube when the organic temperature sensing body is in solid and melted conditions.

5. The thermal fuse with dual elastic clamps of claim 1, wherein a contact surface between the second elastic clamp and the connecting pillar is a flat surface perpendicular to the axis of the insulating cylindrical tube; the contact surface between the first metal elastic clamp and the connecting pillar is also a flat surface perpendicular to the axis of the insulating cylindrical tube.

6. The thermal fuse with dual elastic clamps of claim 5, further comprising an electrical heating-up heater located on an outer wall of the insulating cylindrical tube, wherein the heater heats up the organic temperature sensing body to cut off a circuit.

7. A thermal fuse, comprising:

an insulating cylindrical tube comprising an axial through hole along an axis;

a first metal cap fixed axially on an end of the axial through hole and a first conductive wire fixed on the first metal cap and extending;

a second metal tube fixed axially on the other end of the axial through hole and a second conductive wire fixed on the second metal tube and extending;

wherein the first metal cap and the second metal tube are located inside the insulating cylindrical tube;

wherein the first metal cap, the second metal tube and an inner side wall of the middle part of the axial through hole form a temperature sensing chamber; an organic temperature sensing body, a conductive bridge, an insulating pillar and a spring are located inside the temperature sensing chamber; when the organic temperature sensing body melts, the spring pushes the conductive bridge forward towards a side of the organic temperature sensing body to achieve an electric connection or cut off the electric connection between the first metal cap and the second metal tube;

the conductive bridge further comprises a first convex reed, a second convex reed and a conductive pin; a first end of the first convex reed is connected to the first metal cap; a first end of the second convex reed is connected to the second metal cap; a second end of the first convex reed and a second end of the second convex reed are respectively connected to two ends of the conductive pin; the first metal cap, the first convex reed, the conductive pin, the second convex reed and the second metal cap are electrically connected with each other.

8. A thermal fuse, comprising:

an insulating cylindrical tube comprising an axial through hole along an axis;

a first metal cap fixed axially on an end of the axial through hole and a first conductive wire fixed on the first metal cap and extending outwardly;

a second metal tube fixed axially on the other end of the axial through hole and a second conductive wire fixed on the second metal tube and extending outwardly;

wherein the first metal cap, the second metal tube and an inner side wall of the middle part of the axial through hole form a temperature sensing chamber; an organic temperature sensing body, a conductive bridge, an insulating pillar and a spring are located inside the temperature sensing chamber; when the organic temperature sensing body melts, the spring pushes the conductive bridge forward towards a side of the organic temperature sensing body to achieve an electric connection or cut off the electric connection between the first metal cap and the second metal tube;

wherein the conductive bridge further comprises a conductive pillar and a first circle of wings and a second circle of wings located on the side wall of the conductive pillar; the conductive pillar, the first circle of wings and the second circle of wings are an integrative structure; the first circle of wings is electrically connected with the first metal cap when the organic temperature sensing body is in solid and melted conditions; the second circle of wings is electrically connected with the second metal tube when the organic temperature sensing body is in the solid condition and loses electric connection with the second metal tube when the organic temperature sensing body is in the melted condition.

9. The thermal fuse of claim 8, wherein each of the first circle of wings and second circle of wings comprise at least two wings spaced from each other.

10. The thermal fuse of claim 8, wherein the conductive pillar is a hollow structure; the first circle of wings and second circle of wings are shaped through pressing the hollow structure outwardly.

11. The thermal fuse of claim 8, wherein the conductive pillar is a solid structure; the first circle of wings and second circle of wings are shaped through cutting the solid structure.

12. The thermal fuse of claim 7, further comprising an electrical heating-up heater located on an outer side wall of the insulating cylindrical tube, wherein the heater heats up the organic temperature sensing body to achieve or cut off the electric connection.

13. The thermal fuse of claim 7, wherein the first convex reed and the second convex reed are tube structures; a circle of slots are located on the side wall of the tube structure; a plurality of arc-shaped lug bosses are located between adjacent two slots.

14. The thermal fuse of claim 7, wherein the first convex reed is electrically connected with the first metal cap when the organic temperature sensing body is in solid and melted conditions; the second convex reed is electrically connected with the second metal tube when the organic temperature sensing body is in the solid condition and loses electric connection when the organic temperature sensing body is in the melted condition.

15. A thermal fuse, comprising:

an insulating cylindrical tube comprising an axial through hole along an axis;

a first metal cap fixed axially on an end of the axial through hole and a first conductive wire fixed on the first metal cap and extending;

a second metal tube fixed axially on the other end of the axial through hole and a second conductive wire fixed on the second metal tube and extending;

wherein the first metal cap and the second metal tube are located inside the insulating cylindrical tube;

wherein the first metal cap, the second metal tube and an inner side wall of the middle part of the axial through hole form a temperature sensing chamber; an organic temperature sensing body, a conductive bridge, an insulating pillar and a spring are located inside the temperature sensing chamber; when the organic temperature sensing body melts, the spring pushes the conductive bridge forward towards a side of the organic temperature sensing body to achieve an electric connection or cut off the electric connection between the first metal cap and the second metal tube;

wherein the conductive bridge further comprises a cylindrical elastic convex reed with a plurality of convex arc-shaped parts in both of the ends; the cylindrical elastic convex reed is in close contact with one end face of the temperature sensing body; the cylindrical elastic convex reed is elastically and electrically connected with the first metal cap and the second metal cap; the first metal cap, the cylindrical elastic convex reed and the second metal cap are electrically connected with each other; an insulated supporting pillar is installed on the other end of the cylindrical elastic convex reed and is in close contact with the cylindrical elastic convex reed under an elastic force generated by a compressed spring; the compressed spring is not electrically connected with the cylindrical elastic convex reed with the plurality of convex arc-shaped parts in both of the ends.

16. The thermal fuse of claim 15, wherein the cylindrical elastic convex reed is a tube structure; two circles of slots are located on the side wall of the tube structure; a plurality of arc-shaped lug bosses are located between two adjacent slots.

17. The thermal fuse of claim 15, wherein the cylindrical elastic convex reed is electrically connected with the second metal tube when the organic temperature sensing body is in a solid condition and loses electric connection when the organic temperature sensing body is in a melted condition.

* * * * *